US006186504B1

(12) United States Patent
Maxim

(10) Patent No.: US 6,186,504 B1
(45) Date of Patent: Feb. 13, 2001

(54) COLOR-CHANGE PUZZLE GAME

(75) Inventor: John Maxim, 863 Coventry St., Boca Raton, FL (US) 33487

(73) Assignee: John Maxim, Boca Raton, FL (US)

( * ) Notice: Under 35 U.S.C. 154(b), the term of this patent shall be extended for 0 days.

(21) Appl. No.: 09/350,822

(22) Filed: Jul. 9, 1999

(51) Int. Cl.[7] ..... A63F 9/08

(52) U.S. Cl. ..... 273/153 S; 273/157 A; 434/98; 434/104

(58) Field of Search ..... 463/9, 14; 434/98, 434/103, 104; 273/156, 157 A, 153 S

(56) References Cited

U.S. PATENT DOCUMENTS

| | | | | |
|---|---|---|---|---|
| 3,778,063 | | 12/1973 | Strand | 273/130 AB |
| 3,788,645 | | 1/1974 | Nelson | 273/156 |
| 4,378,116 | | 3/1983 | Rubik | 273/153 S |
| 4,378,117 | | 3/1983 | Rubik | 273/153 S |
| 4,402,510 | * | 9/1983 | Yokoi . | |
| 4,410,180 | | 10/1983 | Clark | 273/156 |
| 4,474,371 | | 10/1984 | Silbermintz | 273/1 G |
| 4,491,326 | | 1/1985 | Halsey, III | 273/157 A |
| 4,605,231 | | 8/1986 | Richman | 273/157 A |
| 4,735,417 | | 4/1988 | Gould | 273/153 S |
| 4,796,891 | | 1/1989 | Milner | 273/153 S |
| 4,815,742 | | 3/1989 | Augustine | 273/157 A |
| 4,978,126 | | 12/1990 | Morosow et al. | 273/153 S |
| 4,983,062 | | 1/1991 | Hour | 401/195 |
| 5,192,209 | * | 3/1993 | Sweet . | |
| 5,213,505 | * | 5/1993 | Laipply . | |
| 5,299,805 | | 4/1994 | Green | 273/157 A |
| 5,427,375 | | 6/1995 | Breckwoldt | 273/153 S |
| 5,529,301 | | 6/1996 | Feller | 273/153 S |
| 5,642,884 | | 7/1997 | Pitcher | 273/157 R |
| 5,769,418 | | 6/1998 | Gilbert et al. | 273/157 A |

* cited by examiner

*Primary Examiner*—William M. Pierce
(74) *Attorney, Agent, or Firm*—Oltman, Flynn & Kubler

(57) ABSTRACT

A puzzle apparatus for providing a user with a challenging puzzle to solve. The apparatus includes a housing having at least one opening therein, a matrix of shaped color-producing media disposed within the housing, and a plurality of generally interengaged, slidable tiles carrying color-producing media thereon, the tiles being proximate the opening of the housing. A light source radiates light through respective ones of the shaped color-producing media of the matrix, then through respective ones of the color-producing media of the slidable tiles, and then to the eye of the user such that at least some of the light seen by the user has passed through both a color-producing medium in the matrix and a color-producing medium in one of the tiles. The respective color-producing media interact to produce a light color other than that which would have been produced if the light had passed through only one of the color-producing media. The slidable tiles are relatively arrangeable to produce a solution to the puzzle. The solution includes a predetermined pattern of colors as viewable by the user when looking generally toward the opening of the housing.

39 Claims, 3 Drawing Sheets

FIG. 1
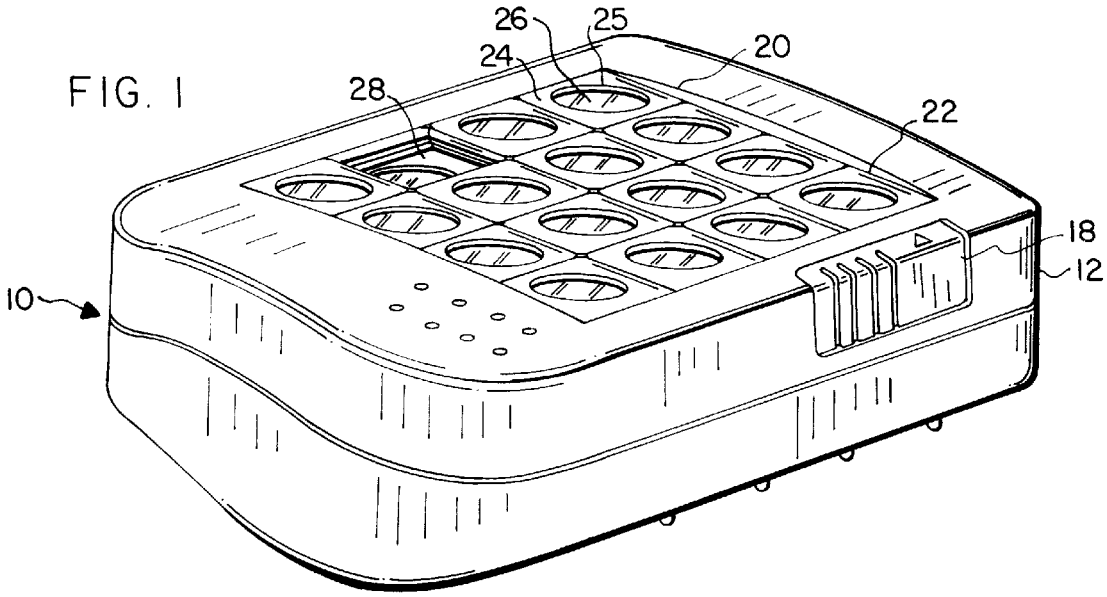
FIG. 3
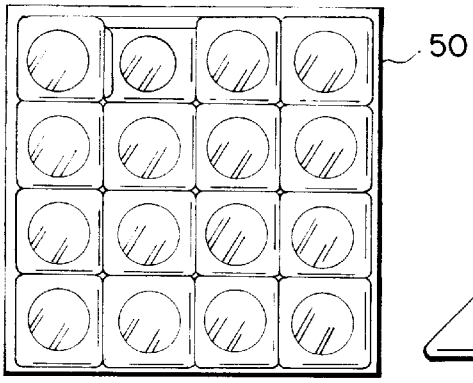
FIG. 5
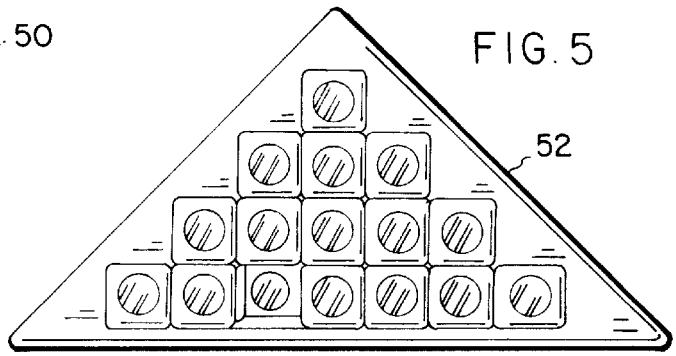
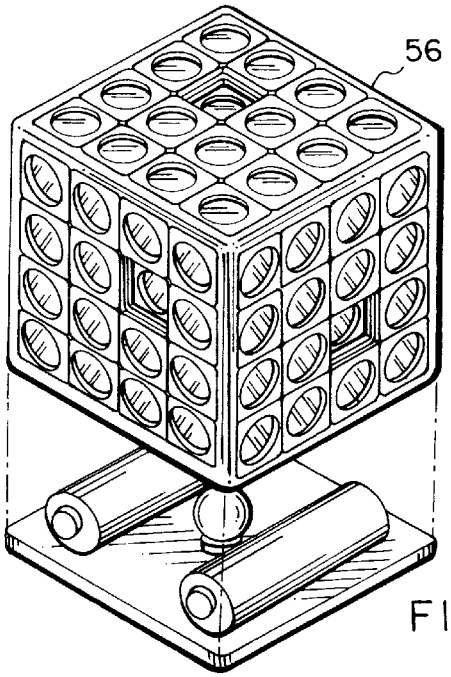
FIG. 4
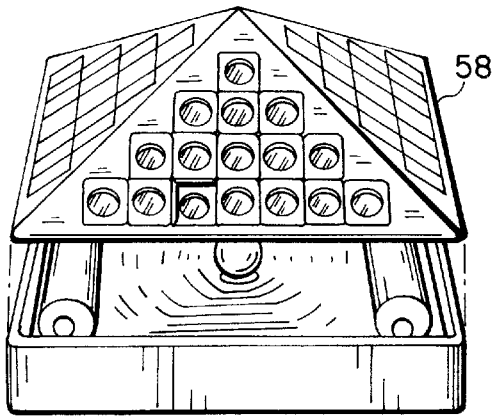
FIG. 6

COLOR-CHANGE PUZZLE GAME

BACKGROUND OF THE INVENTION

People have long been fascinated, entertained, and enlightened by logic-based puzzles. The enormous variety of such puzzles provides wondrous delight to both children and adults, and studies have confirmed that analytical thought of the type elicited by such logic-based puzzles can improve one's capacity for learning and recalling information. Though a number of factors relate to the enjoyability of a particular logic-based puzzle for a particular person, the level of complexity, the configurability of the pieces, and the presence of colors and/or sounds may all contribute.

Of the many types of logic-based puzzles, one that is known and presents a logical puzzle somewhat akin to that presented by an embodiment of the invention is a 4×4 square grid having fifteen slidable tiles numbered 1–15 occupying fifteen of the sixteen spaces within the grid. Tiles can be slid sequentially into the empty space in the grid, thereby altering the relative positions of the numbered tiles. The typical solution to such a puzzle is obtained when the tiles are numerically ordered 1–15 reading left-to-right across the columns and then down the rows.

Another well-known logic-based puzzle is the Rubik's Cube®. Although this cube-shaped puzzle having six faces each including a 3×3 grid of nine colored stickers has an appearance similar to an embodiment of the invention, it actually is very dissimilar in construction and solution logic. The stickers adhere to 26 plastic pieces emanating radially from a central core. The various perpendicular planes of eight or nine pieces are rotatable about the central core to reconfigure the cube and the arrangement of stickers thereon. The typical solution to this puzzle is obtained when all nine stickers one each face are of identical color and each of the six faces of the cube has stickers of a different color from each of the other five faces.

As many other logic-based puzzles exist using recognizable patterns of colors, letters, numbers, and the like to distinguish solution states from non-solution states, consumers desire puzzles that provide a "twist" from more conventional ones.

SUMMARY OF THE INVENTION

In accordance with the invention there is provided a puzzle apparatus for providing a user with a challenging puzzle to solve. The apparatus includes a housing having at least one opening therein, a matrix of shaped color-producing media disposed within the housing, and a plurality of generally interengaging, slidable tiles carrying color-producing media thereon, the tiles being proximate the opening of the housing. A light source radiates light through respective ones of the shaped color-producing media of the matrix, then through respective ones of the color-producing media of the slidable tiles, and then to the eye of the user such that at least some of the light seen by the user has passed through both a color-producing medium in the matrix and a color-producing medium in one of the tiles.

The respective color-producing media interact to produce a light color other than that which would have been produced if the light had passed through only one of the color-producing media. The slidable tiles are relatively arrangeable to produce a solution to the puzzle. The solution includes a predetermined pattern of colors as viewable by the user when looking generally toward the opening of the housing. A method for solving a puzzle in accordance with the invention is also provided.

The inventive puzzle apparatus presents a challenging logic-based puzzle wherein the user attempts to arrange tiles within one or more housing openings until a particular predetermined pattern is achieved (the solution). The "twist" is that, as the tiles are arranged, they pass over and align with different portions of the underlying matrix, thereby causing the color of light emitted through the tiles to change as their respective positions within the housing openings change. This makes it very challenging to arrange the tiles to display a predetermined pattern of light colors.

An art set having many common features with the puzzle and in accordance with the invention is also provided, though, unlike with respect to the puzzle, there is no predetermined arrangement of tiles (i.e. solution) that is sought to be formed; rather the object of the art set is to facilitate the creation of visually pleasing, colorful, and artistic tile arrangements.

BRIEF DESCRIPTION OF THE DRAWINGS

FIG. 1 is a perspective view of a puzzle apparatus in accordance with the invention;

FIG. 3 is a top plan view of the puzzle face portion of a square, two-dimensional puzzle apparatus in accordance with an embodiment of the invention;

FIG. 4 is a perspective view of a cube-shaped, three-dimensional puzzle apparatus in accordance with an embodiment of the invention;

FIG. 5 is a top plan view of the puzzle face portion of a triangular, two-dimensional puzzle apparatus in accordance with an embodiment of the invention;

FIG. 6 is a perspective view of a pyramid-shaped, three-dimensional puzzle apparatus in accordance with an embodiment of the invention;

DETAILED DESCRIPTION OF PREFERRED EMBODIMENTS

Figure 2:
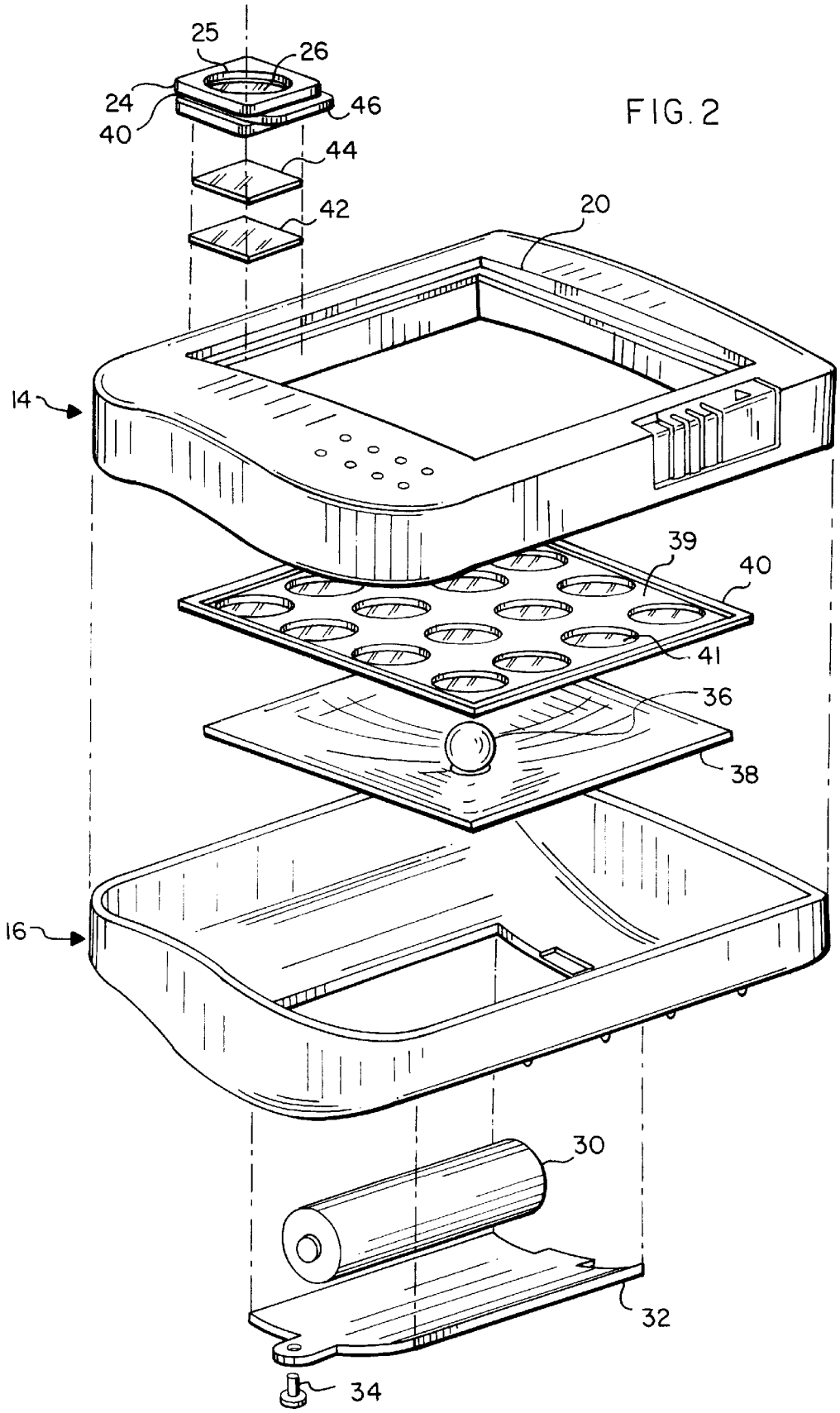
FIG. 2 is an exploded perspective view of the puzzle apparatus of FIG. 1 to facilitate viewing individual components thereof.

A preferred embodiment of the invention is described herein and shown in puzzle apparatus 10 in FIG. 1 and, in exploded form, in FIG. 2. The puzzle apparatus 10 includes a rigid housing 12 having a top portion 14 and a bottom portion 16 for cooperatively containing the innards of the apparatus.

The housing bottom 16 has a detachable battery cover portion 32 that serves to enclose and cover one or more batteries 30 inside the housing 12. The battery cover portion 32 is detachable by a battery cover screw 34. The battery 30 powers light bulb 36 which may be toggled between "on" and "off" states by a slidable power switch 18 on the housing top 14.

The light bulb 36 is disposed generally centrally relative to an underlying concave reflector 38 so that light rays emitted primarily laterally and downwardly from the bulb 36 are generally redirected upwardly with the remainder of the emitted light through a matrix 40 disposed above the bulb 36 and reflector 38. In the shown embodiment, the matrix 40 is a generally planar matrix of contiguous, generally rectangular or square individual film laminates 41 having a polarizing quality and defined axis of polarization. The matrix 40 may have an attached spacer 39 for limiting unintended overlap of non-parallel colored/polarized light rays emanating from distinct individual film laminates 41.

After passing upwardly through the matrix 40, the light continues upwardly to an array of slidable tiles 22 disposed in an opening 20 of the housing 12. In this manner the matrix 40 underlies the slidable tiles 22. Each of the tiles 22 includes a plastic tile body 24 having a central window 25 with a tile polarizer 26 disposed in the window 25. The tile polarizer 26, like the individual portions 41 of the underlying matrix 40 in the described embodiment, is a film laminate having a polarizing quality and defined axis of polarization.

One or more refractive layers (42 and 44) may be interposed between the laminate films of the matrix 40 and the tiles 22 to enhance or define the color of the light emanating from the tiles 22. In the described and illustrated embodiment, a first refractive layer 42 is adherable to the top surface of the matrix 40 while a second refractive layer 44 is adherable to the bottom of each of the slidable tiles 22.

In the described embodiment, fifteen of the sixteen square spaces defined by a 4×4 array in the housing opening 20 are occupied by a slidable tile 22, while the remaining square space 28 is unoccupied. Each of the generally square tiles 22 of the described embodiment has a tile projection 46 projecting laterally along two adjacent sides of the tile 22 and a complementary tile groove 48 laterally inset along the other two sides of the tile 22. The projections 46 and grooves 48 from adjacent tiles within the array interengage to enable one tile to be slid laterally alongside another. This permits a square tile disposed alongside any of the four sides of the square space 28 to be slid therein, thereby creating a new unoccupied space vacated by the moved tile. Of course, if the unoccupied space 28 is near an edge or corner of the housing opening 20, there may be fewer than four tiles capable of being slid into it. Sequentially sliding tiles to fill the respective unoccupied spaces created by the displacement of the previous tile permits rearrangement of the tiles 22 within the array.

Each tile has a tile polarizer 26 within its window 25, and the polarizer 26 travels with the tile when the tile is laterally displaced into an unoccupied space 28. The underlying matrix 40 in the described embodiment has a distinct polarizing laminate associated with each of the 16 positions of the 4×4 array defined within the housing opening 20. Thus, as a tile slides from one position in the array to another, the individual polarizing laminate of the underlying matrix 40 over which the tile is disposed changes. Because the resultant color viewed through a tile by the user is dependent upon the relative angles between the tile polarizer 26 of the tile 22, the corresponding laminate film 41 of the underlying matrix 40, and any axial orientation of the interposed refractive layers (42 and 44), the color seen through a tile 22 will change when it is laterally displaced if the axes of polarization of the individual film laminates 41 corresponding to the two array positions from which and to which the tile moved are not parallel.

In particular, if a refractive layer is interposed between two polarizers wherein the axis/grain of the refractive layer is rotationally/angularly offset from one polarizer by 450, when the other polarizer is rotated in a full 360° circle, light transmitted through the polarizers and interposed refractive layer will be subject to four alternating 90° cycles of color change—between longer wavelengths (red) when the polarizer axes are aligned and shorter wavelengths (blue) when the axes are mutually perpendicular.

Thus, by orienting each of the individual film laminates 41 of the underlying matrix 40 differently (i.e. with a different angle for the axis of polarization), it is possible that a single tile will emit a different color when it is in each of the positions of the array. This feature provides the "twist" of the logic-based puzzle because it is very difficult to mentally conceive an appropriate sequence of tile sliding in order to arrange the tiles into the predetermined color pattern (solution) when the color emitted by each tile changes each time it is moved.

The puzzle apparatus can have a single, unique solution or it can have multiple solutions. A solution might involve arranging the tiles so that all of them display an identical color. Other solutions might involve having rows or columns of distinct colors or forming recognizable patterns such as a "smile face". Furthermore, different solutions could be associated with different levels of complexity based on how the underlying matrix is configured with respect to the individual polarizing laminates thereof.

The described embodiment employs the individual polarizing laminates 41 of the underlying matrix 40 and the tile polarizers 26 of the slidable tiles 22 (in addition to refractive layers 42 and 44) for its color-producing media. It is well-known that passing light of mixed wavelength through multiple polarizers (and through refractive media) can filter subsets of wavelengths out of the mix and change the resultant color of the light. In particular, the polarizing laminates 41 and the tile polarizers 26 can be Polaroid's cellulose acetate butyrate (CAB) laminated linear polarizer, such as HNT32 (0.010 inches thick, PID #605220). The refractive layers 42 and 44 can be Scotch 3M brand clear tape (#142 Clear, UPC 0-51131-64204-1, Stock #70-0706-7839-9).

It is important to note that the embodiment described above and shown in FIGS. 1 and 2 represents a single embodiment of the invention, and a significant range of alternative embodiments is contemplated to be within the scope of the invention. Without being exhaustive, the following list identifies examples of non-limiting aspects of the previously described embodiment and some specific alternatives considered to be within the scope of the invention (FIGS. 3–8 depict a few embodiments of the invention): the slidable tiles can be of a shape other than square and need not be slidable only within a rectangular array; the housing opening can be of a shape other than square; the puzzle apparatus can be two or three dimensional and can have a single or multiple housing openings in which arrays of slidable tiles are arrangeable; the light source can be something other than a battery-powered light bulb, such as natural light; the color-producing media need not be polarized laminate films, but can be any color-producing media including, for example, translucent, colored film or gel-filled cells; the refractive layers may be different in number or kind than shown and described above; and the refractive layer can be homogeneous across the entire matrix or may be comprised of distinct, appropriately shaped and positioned refractive media. Additionally, an electronic game or computer software which visually reproduces the described color puzzle is considered to be within the scope of the invention.

FIG. 3 depicts a two-dimensional puzzle face 50 having a 4×4 array of slidable tile spaces akin to that shown in the embodiment of FIGS. 1 and 2, and FIG. 5 depicts a two-dimensional, generally triangular puzzle face 52 having a generally triangularly shaped array of tile spaces. Either of these embodiments may have different dimensions and still be within the contemplated scope of invention. FIG. 4 shows a three-dimensional, cube-shaped puzzle apparatus 56 having a 4×4 array of tile spaces, akin to the array of FIG. 3, on multiple faces of the cube. Similarly, FIG. 6 shows a three-dimensional, pyramid-shaped puzzle apparatus 58 having a generally triangular array of tile spaces on each of the triangularly shaped sides of the pyramid.

Figure 7:
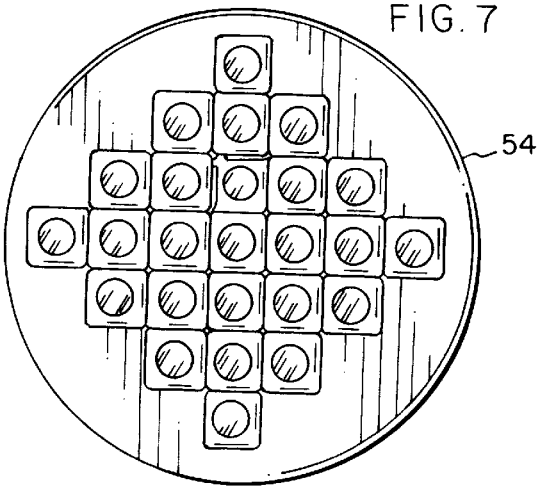
FIG. 7 is a top plan view of the puzzle face portion of a disc-shaped, two-dimensional puzzle apparatus in accordance with an embodiment of the invention.
Figure 8:
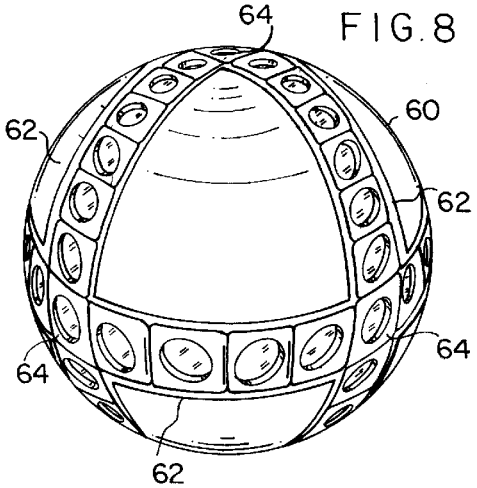
FIG. 8 is a perspective view of a spherical, three-dimensional puzzle apparatus in accordance with an embodiment of the invention.

FIG. 7 shows a two-dimensional generally circular or disc-shaped puzzle face 54 having a generally circular or disc-shaped array of tile spaces. As with other embodiments, the dimensions may be altered without changing the nature of the embodiment. For example, the 1-3-5-7-5-3-1 arrangement of FIG. 7 could also be 3-5-7-7-7-5-3 within the scope of the invention. FIG. 8 shows a generally spherical puzzle apparatus 60 having circumferentially disposed tile spaces. Preferably, as seen in FIG. 8, three mutually perpendicular great circumferential paths 62 of the sphere define the array of tile spaces with the six points of intersection 64 (three shown in FIG. 8) permitting an individual slidable tile to be moved from one circumferential path 62 to another. Each of the three-dimensional designs would require an internal light source (examples shown in FIGS. 4 and 6) and an underlying matrix interposed between the light source and the respective slidable tiles wherein the individual color-producing media of the matrix corresponded positionally to each of the tile spaces of the various tile arrays.

Figure 9:
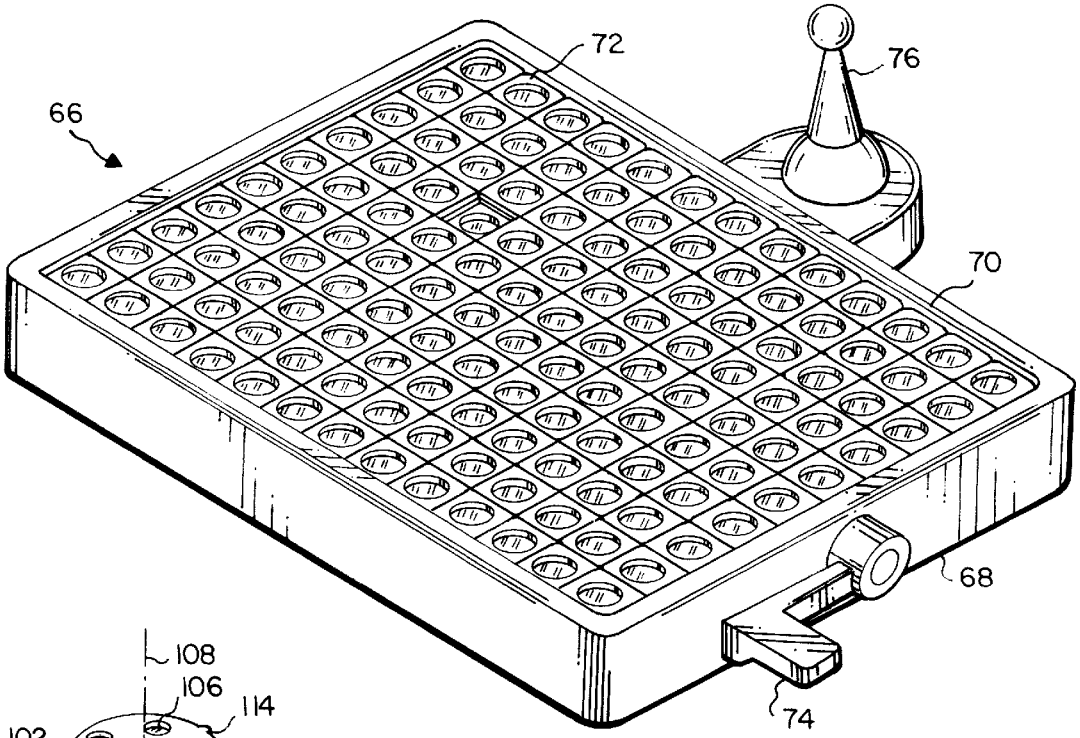
FIG. 9 is a perspective view of an art set in accordance with the invention.

FIG. 9 depicts an art set 66 in accordance with invention. Unlike with respect to the puzzle, the art set lacks one or more predetermined arrangements of tiles that is sought to be produced. Instead, the object of the art set is to facilitate the creation of visually pleasing, colorful, and artistic tile arrangements, and, as described below, may even be used to produce a sequence of color arrangements having an animation-like effect.

The art set 66 includes a housing 68 for containing the innards thereof. The housing may include (not shown in FIG. 9) a battery cover portion for enclosing and covering one or more batteries inside the housing.

A light source, such as a light bulb and underlying reflector, is disposed within the housing so that light rays may be directed generally upwardly toward an opening 70 in the housing. As with regard to the puzzle apparatus 10, the art set 66 includes a matrix of contiguous, individual color-producing media (such as film laminates having a polarizing quality and a refracting medium).

The light travels from the internal lighting source through the matrix to an array of slidable tiles 72 disposed in an the opening 70 of the housing 68. As with the puzzle apparatus, each of the tiles includes a plastic tile body having a central window with a tile polarizer disposed in the window. The tile polarizer, like the individual color-producing media of the matrix, is preferably a film laminate having a polarizing quality and defined axis of polarization. One or more refractive layers may be interposed between the laminate films of the matrix and the tiles 72 to enhance or define the color of the light emanating from the tiles 72.

While FIG. 9 shows a 13×10 rectangular array of tile spaces, a differently sized or differently shaped array could also be used. As with the puzzle apparatus, a single tile space of the array is unoccupied by a tile so that the tiles may be slidably arranged within the array as described above.

As with the puzzle apparatus, each tile 72 has a tile polarizer within its window, and the polarizer travels with the tile when the tile is laterally displaced. As the underlying matrix may have a distinct polarizing laminate associated with each of the array positions within the housing opening 70, as a tile 72 slides from one position in the array to another, the individual polarizing laminate of the underlying matrix over which the tile 72 is disposed changes. Because the resultant color viewed through a tile by the user is dependent upon the relative angles between the tile polarizer, the corresponding laminate film of the underlying matrix, and any axial properties of interposed refractive layers, the color seen through a tile 72 will change when it is laterally displaced if the axes of polarization of the individual film laminates 41 corresponding to the two array positions from which and to which the tile moved are not parallel.

As shown in FIG. 9, the art set 66 may include a lever 74 and/or a joystick 76 for shifting the underlying matrix by one or more positions upward, downward, to the left, and to the right. This enables a particular artistic design to be radically altered merely by adjusting the lever 74 or the joystick 76. By repositioning the underlying matrix, the tiles fall into different correspondence with specific underlying individual color-producing media (i.e., film laminates) to alter the resultant colors emanating from the tiles. With careful design, a shift of the underlying matrix can even provide animation of a specific image.

Figure 10:
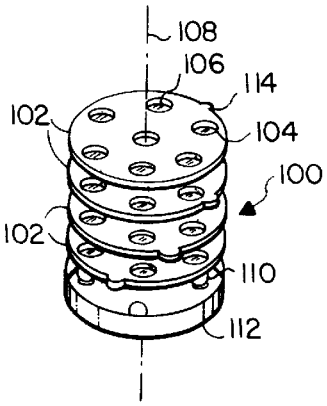
FIG. 10 is an exploded view of a rotary disc puzzle in accordance with the invention.

FIG. 10 depicts a rotary disc puzzle 100 in accordance with the invention. Instead of having relatively slidable tiles, as is described with respect to the aforementioned embodiments of the invention, the rotary disc puzzle 100 includes a plurality of disc-shaped plates 102. Each plate 102 has one or more windows 104 having color-producing media 106 therein, such as the polarizer/refractive laminate combination described above. The plates 102 are rotatable about a common axis 108. A light source, such as a light bulb 110 (and optional underlying reflector which is not shown), is disposed within a housing 112. The housing 112 may include a battery cover portion for enclosing and covering one or more batteries within the housing 112.

Like the aforementioned puzzles, the rotary disc puzzle 100 has one or more predetermined arrangements constituting solutions to the puzzle. The plates 102 are rotatable about the common axis 108 such that when the windows 104 from distinct plates overlap, different shades of light are produced. Projecting tabs 114 or other means may be present to facilitate rotation of individual plates 102.

An object of the puzzle is to arrange (i.e. rotate) the plates 102 such that one of the predetermined solutions is achieved, such as producing a uniform color of light in each window 104 in the plate viewable by the user (i.e. the top plate). Another possible object of the puzzle solution is to arrange the plates 102 such that a different color of light is seen through each window 104 in the top plate. It will be appreciated that the level of difficulty associated with the puzzle increases with the number of plates 102, the number of colors generated by the color-producing media 106, and the number of windows 104 on the respective plates 102.

As with respect to the puzzle apparatus described and shown in FIGS. 1 and 2, the art set 66 and the rotary disc puzzle 100 represent only particular embodiments of the invention, and a significant range of alternative embodiments is contemplated to be within the scope of the invention. In particular, and without being exhaustive, the above-enumerated list of non-limiting aspects and specific alternatives considered to be within the scope of the invention apply to the art set as well as to the puzzle apparatus. The invention is defined by the following claims.

What is claimed is:

1. A puzzle apparatus for providing a user with a challenging puzzle to solve, said apparatus comprising:

a housing having at least one opening therein;

a matrix of shaped color-producing media disposed within said housing; and a plurality of generally interengaged, slidable tiles carrying color-producing media thereon, said tiles being proximate said opening of said housing;

a light source oriented to direct light to said shaped color-producing media;

wherein said light source radiates light through respective media of said shaped color-producing media of said matrix, then through respective ones of said color-producing media of said slidable tiles, and then to the eye of the user such that at least some of said light seen by the user has passed through both a color-producing medium in said matrix and a color-producing medium in one of said tiles, said respective color-producing media interacting to produce a light color other than that which would have been produced if the light had passed through only one of said color-producing media; and wherein said slidable tiles are relatively arrangeable to produce a solution to said puzzle, said solution comprising a predetermined pattern of colors as viewable by the user when looking generally toward said opening of said housing.

2. An apparatus in accordance with claim 1 wherein said light source includes a light bulb disposed within said housing.

3. An apparatus in accordance with claim 2 wherein said apparatus further includes a reflector disposed in said housing for generally directing light emitted from said light source toward said opening of said housing.

4. An apparatus in accordance with claim 2 wherein said apparatus further includes a battery disposed within said housing for providing power to said light source.

5. An apparatus in accordance with claim 1 wherein said color-producing media of said matrix and said color-producing media of said slidable tiles include polarizing laminates having respective alignment axes, and wherein at least one of said color-producing media includes a refracting laminate having an alignment axis, said refracting laminate disposed between said respective polarizing laminates, such that when light passes through both polarizing laminates and said refracting laminate therebetween, the resultant color of said light is determined by the relative angular orientation of said alignment axes of said polarizing laminates and said refracting laminate.

6. An apparatus in accordance with claim 5 wherein said refracting laminate is in adherence with said polarizing laminate of one of said slidable tiles.

7. An apparatus in accordance with claim 5 wherein said color-producing media of said matrix and said color-producing media of said slidable tiles each include both a polarizing laminate and a refracting laminate such that the respective refracting laminates are disposed between the respective polarizing laminates.

8. An apparatus in accordance with claim 1 wherein said color-producing media of said matrix and said color-producing media of said slidable tiles are individually colored laminates, such that each laminate filters certain wavelength ranges within the visible color spectrum and the resultant color of light is determined by the visible ranges not filtered by either laminate.

9. An apparatus in accordance with claim 1 wherein said color-producing media of said matrix and said color-producing media of said slidable tiles are individually colored gel-filled cells, such that each gel-filled cell filters certain wavelength ranges within the visible color spectrum and the resultant color of light is determined by the visible ranges not filtered by either gel-filled cell.

10. An apparatus in accordance with claim 1 wherein said slidable tiles have sides and are generally interlocking and wherein the shapes of said plurality of slidable tiles are generally squares and said tiles slide in directions generally parallel to and perpendicular to the sides of said squares.

11. An apparatus in accordance with claim 10 wherein said plurality of tiles cumulatively form a generally rectangular pattern.

12. An apparatus in accordance with claim 11 wherein said plurality of tiles cumulatively form a generally square pattern.

13. An apparatus in accordance with claim 10 wherein said plurality of tiles cumulatively form a generally triangular pattern.

14. An apparatus in accordance with claim 10 wherein said plurality of tiles cumulatively form a generally disc-shaped pattern.

15. An apparatus in accordance with claim 1 wherein said housing has a plurality of openings therein and said apparatus further includes a plurality of generally interlocking, slidable tiles carrying color-producing media proximate each of said openings of said housing.

16. An apparatus in accordance with claim 15 wherein said housing is generally in the shape of a cube.

17. An apparatus in accordance with claim 15 wherein said housing is generally in the shape of a pyramid.

18. A puzzle apparatus for providing a user with a challenging puzzle to solve, said apparatus comprising:

a generally spherical housing having at least one generally circumferential opening therein;

a generally circular matrix of shaped color-producing media disposed within said housing; and a plurality of generally interengaged, slidable tiles carrying color-producing media thereon, said tiles being proximate said opening of said housing;

a light source oriented to direct light to said shaped color-producing media;

wherein said light source radiates light from proximate the center of said generally spherical housing through respective media of said shaped color-producing media of generally circular matrix, then through respective media of said color-producing media of said slidable tiles, and then to the eye of the user such that at least some of said light seen by the user has passed through both a color-producing medium in said circular matrix and a color-producing medium in one of said tiles, said respective color-producing media interacting to produce a light color other than that which would have been produced if the light had passed through only one of said color-producing media; and wherein said slidable tiles are relatively arrangeable to produce a solution to said puzzle, said solution comprising a predetermined pattern of colors as viewable by the user when looking generally toward said opening of said housing.

19. A puzzle apparatus in accordance with claim 18 wherein said housing includes a plurality of intersecting, generally circumferential openings therein and said apparatus further includes a plurality of circular matrices of shaped color-producing media in radial correspondence with said plurality of intersecting circumferential openings.

20. An art set for facilitating the creation of artistic patterns of colored light, said art set apparatus comprising:

a housing having at least one opening therein;

a matrix of shaped color-producing media disposed within said housing; and a plurality of generally interengaged, slidable tiles carrying color-producing media thereon, said tiles being proximate said opening of said housing;

a light source oriented to direct light to said shaped color-producing media;

wherein said light source radiates light through respective media of said shaped color-producing media of said matrix, then through respective media of said color-producing media of said slidable tiles, and then to the eye of the user such that at least some of said light seen by the user has passed through both a color-producing medium in said matrix and a color-producing medium in one of said tiles, said respective color-producing media interacting to produce a light color other than that which would have been produced if the light had passed through only one of said color-producing media.

21. An apparatus in accordance with claim 20 wherein said light source includes a light bulb disposed within said housing.

22. An apparatus in accordance with claim 21 wherein said apparatus further includes a reflector disposed in said housing for generally directing light emitted from said light source toward said opening of said housing.

23. An apparatus in accordance with claim 21 wherein said apparatus further includes a battery disposed within said housing for providing power to said light source.

24. An apparatus in accordance with claim 20 wherein said color-producing media of said matrix and said color-producing media of said slidable tiles include polarizing laminates having respective alignment axes, and wherein at least one of said color-producing media includes a refracting laminate having an alignment axis, said refracting laminate disposed between said respective polarizing laminates, such that when light passes through both polarizing laminates and said refracting laminate therebetween, the resultant color of said light is determined by the relative angular orientation of said alignment axes of said polarizing laminates and said refracting laminate.

25. An apparatus in accordance with claim 24 wherein said refracting laminate is in adherence with said polarizing laminate of one of said slidable tiles.

26. An apparatus in accordance with claim 24 wherein said color-producing media of said matrix and said color-producing media of said slidable tiles each include both a polarizing laminate and a refracting laminate such that the respective refracting laminates are disposed between the respective polarizing laminates.

27. An apparatus in accordance with claim 24 further including a refractive element generally aligned with said matrix of color-producing media and said housing opening.

28. An apparatus in accordance with claim 27 wherein said refractive element includes an array of distinct refractive media in general positional correspondence to said polarizing laminates and said shaped color-producing media of said matrix.

29. An apparatus in accordance with claim 27 wherein at least one of said matrix of shaped color-producing media and said refractive medium is translatable within its plane to alter the correspondence between respective ones of said shaped color-producing media, said refractive media, and said tiles carrying color-producing media thereon, and to alter the resultant pattern of colored light emitted from said apparatus.

30. An apparatus in accordance with claim 20 wherein said color-producing media of said matrix and said color-producing media of said slidable tiles are individually colored laminates, such that each laminate filters certain wavelength ranges within the visible color spectrum and the resultant color of light is determined by the visible ranges not filtered by either laminate.

31. An apparatus in accordance with claim 20 wherein said color-producing media of said matrix and said color-producing media of said slidable tiles are individually colored gel-filled cells, such that each gel-filled cell filters certain wavelength ranges within the visible color spectrum and the resultant color of light is determined by the visible ranges not filtered by either gel-filled cell.

32. An apparatus in accordance with claim 20 wherein the shapes of said plurality of generally interlocking, slidable tiles are generally squares and said tiles slide in directions generally parallel to and perpendicular to the sides of said squares.

33. An apparatus in accordance with claim 32 wherein said plurality of tiles cumulatively form a generally rectangular pattern.

34. A method for a user to solve a puzzle presented by a puzzle apparatus wherein said apparatus includes a housing having at least one opening therein, a matrix of shaped color-producing media disposed within said housing, and a plurality of generally interengaged, slidable tiles carrying color-producing media thereon, said tiles being proximate said opening of said housing, wherein a light source radiates light through respective ones of said shaped color-producing media of said matrix, then through respective ones of said color-producing media of said slidable tiles, and then to the eye of said user such that at least some of said light seen by said user has passed through both a color-producing medium in said matrix and a color-producing medium in one of said tiles, said respective color-producing media interacting to produce a light color other than what which would have been produced if the light had passed through only one of said color-producing media, said method comprising the following steps:

(a) sliding an individual tile relatively to others of said tiles within said generally interlocking configuration such that said tile is brought into a different aligned correspondence from one color-producing medium of said matrix to another color-producing medium of said matrix; and (b) repeating step (a) until said interlocking tiles are arranged to produce a solution to said puzzle, said solution comprising a predetermined pattern of colors as viewable by said user when looking generally toward said opening of said housing.

35. A puzzle apparatus for providing a user with a challenging puzzle to solve, said apparatus comprising:

a housing having at least one opening therein; and a plurality of generally parallel plates having windows containing color-producing media therein, said plates being disposed in said housing and being individually rotatable about a common axis to align windows from individual said plates;

a light source oriented to direct light to said shaped color-producing media;

wherein said light source radiates light through respective color-producing media of said aligned windows, and then to the eye of the user such that at least some of said light seen by the user has passed through color-producing media in windows of at least two of said plurality of plates, said color-producing media interacting to produce a light color other than that which would have been produced if the light had not passed through one of said color-producing media; and wherein said plates are individually rotatable to produce a solution to said puzzle, said solution comprising a predetermined pattern of colors as viewable by the user when looking generally toward said opening of said housing.

36. An apparatus in accordance with claim 35 wherein said color-producing media of said plates include polarizing laminates having respective alignment axes, and wherein at least one of said color-producing media includes a refracting laminate having an alignment axis, said refracting laminate disposed between said respective polarizing laminates, such that when light passes through both polarizing laminates and said refracting laminate therebetween, the resultant color of said light is determined by the relative angular orientation of said alignment axes of said polarizing laminates and said refracting laminate.

37. An apparatus in accordance with claim 36 wherein said refracting laminate is in adherence with said polarizing laminate of one of said plates.

38. An apparatus in accordance with claim 35 wherein said color-producing media of said plates are individually colored laminates, such that each laminate filters certain wavelength ranges within the visible color spectrum and the resultant color of light is determined by the visible ranges not filtered by either laminate.

39. An apparatus in accordance with claim 35 wherein said color-producing media of said plates are individually colored gel-filled cells, such that each gel-filled cell filters certain wavelength ranges within the visible color spectrum and the resultant color of light is determined by the visible ranges not filtered by either gel-filled cell.

* * * * *